US009682002B2

(12) United States Patent
Belin

(10) Patent No.: US 9,682,002 B2
(45) Date of Patent: Jun. 20, 2017

(54) EXERCISE DEVICE ASSEMBLY

(71) Applicant: George E. Belin, Branson, MO (US)

(72) Inventor: George E. Belin, Branson, MO (US)

( * ) Notice: Subject to any disclaimer, the term of this patent is extended or adjusted under 35 U.S.C. 154(b) by 538 days.

(21) Appl. No.: 14/314,786

(22) Filed: Jun. 25, 2014

(65) Prior Publication Data

US 2015/0374570 A1 Dec. 31, 2015

(51) Int. Cl.
*A61H 1/00* (2006.01)
*A61H 1/02* (2006.01)

(52) U.S. Cl.
CPC ... *A61H 1/0244* (2013.01); *A61H 2001/0251* (2013.01); *A61H 2201/0142* (2013.01); *A61H 2201/0157* (2013.01); *A61H 2201/0161* (2013.01); *A61H 2201/1215* (2013.01); *A61H 2201/164* (2013.01); *A61H 2201/1645* (2013.01); *A61H 2203/0456* (2013.01)

(58) Field of Classification Search
CPC ..... A63B 23/08; A63B 26/00; A61H 1/0244; A61H 1/024; A61H 1/0237; A61H 2201/164; A61H 2201/0146; A61H 2203/0456
See application file for complete search history.

(56) References Cited

U.S. PATENT DOCUMENTS 2,408,597 A * 10/1946 Belling ..... A63B 21/068 482/132
4,583,555 A 4/1986 Malcom et al.
4,733,859 A 3/1988 Kock et al.
4,913,163 A 4/1990 Roger et al.
4,949,712 A 8/1990 Torii
4,969,471 A 11/1990 Daniel et al.
5,025,802 A 6/1991 Laico et al.
5,063,918 A 11/1991 Guhl
5,107,822 A 4/1992 Ohashi
5,156,163 A 10/1992 Watkins et al.
5,221,242 A 6/1993 Weber et al.
5,290,220 A 3/1994 Guhl
5,417,644 A 5/1995 Lee
5,419,753 A 5/1995 Wang
5,468,215 A 11/1995 Park
5,489,257 A 2/1996 Li
6,013,039 A 1/2000 Watkins et al.
6,285,144 B1 9/2001 Shih
6,342,042 B1 1/2002 Martin
6,491,650 B2 12/2002 Huang
6,511,447 B1 1/2003 Huang
6,572,568 B2 6/2003 Huang
6,685,658 B1 2/2004 Dietz et al.
6,948,501 B2 9/2005 Rastegar et al.
(Continued)

*Primary Examiner* — Justine Yu
*Assistant Examiner* — Timothy Stanis
(74) *Attorney, Agent, or Firm* — Merchant & Gould P.C.

(57) ABSTRACT

An exercise device assembly including an adjustable exercise device and a bed adapter is disclosed. The bed adapter may include a main body defining a first side and a second side. The main body may be provided with a first plurality of receptacles and a second plurality of receptacles that are for receiving and securing support members of the exercise device. In one aspect, the receptacles have a sidewall connecting the main body first side to a recessed support surface of the receptacle such that the support members of the exercise device are securely retained on the bed adapter.

11 Claims, 8 Drawing Sheets

(56) References Cited

U.S. PATENT DOCUMENTS

| | | | | |
|---|---|---|---|---|
| 7,241,271 | B2 | 7/2007 | Kurata et al. | |
| 7,381,172 | B1 | 6/2008 | Gehrke | |
| 7,976,482 | B2 | 7/2011 | Mayr | |
| 8,435,192 | B2 | 5/2013 | Belin | |
| 2003/0060339 | A1 | 3/2003 | Ravikumar et al. | |
| 2003/0224912 | A1* | 12/2003 | Zagone ..... | A63B 21/023<br>482/80 |
| 2008/0276375 | A1 | 11/2008 | Gehrke | |

* cited by examiner

EXERCISE DEVICE ASSEMBLY

BACKGROUND

Therapeutic exercise devices utilizing reciprocating ankle rests are known. In use, a person will lie flat on his back and place his ankles on the ankle rest. In operation, the ankle rest reciprocates horizontally in a side-to-side motion which causes the legs to swing back and forth. In some instances, a person who could receive treatment cannot receive adequate treatment from such a device due to the person being bed ridden and the device not being able to be adequately supported on a bed. Improvements are desired.

SUMMARY

An exercise device assembly is disclosed. The exercise device assembly can include an adjustable exercise device having a base plate supporting a reciprocating ankle rest that has a longitudinal axis. The base plate can be provided with a first plurality of support members at a bottom side for supporting the base frame. The exercise device can also include a knee rest connected to the housing, wherein the knee rest has a longitudinal axis that is generally parallel to a longitudinal axis of the ankle rest. In one aspect, the knee rest is adjustable in a horizontal direction relative to the longitudinal axis of the ankle rest. The knee rest can also be provided with a second plurality of support members at a bottom side for supporting the knee rest.

The exercise device assembly may also include a bed adapter which may be attached or unattached to the exercise device. In one aspect, the bed adapter may include a main body defining a first side and a second side. A first plurality of receptacles can be provided that receive and retain the first plurality of support members, wherein each of the first plurality of receptacles being disposed in the main body first side and having a sidewall connecting the main body first side to a support surface of the receptacle. Similarly, a second plurality of receptacles can be provided that receive and retain the second plurality of support members, wherein each of the second plurality of receptacles being disposed in the main body first side and having a sidewall connecting the main body first side to a support surface of the receptacle.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Exercise Device

Figure 1:
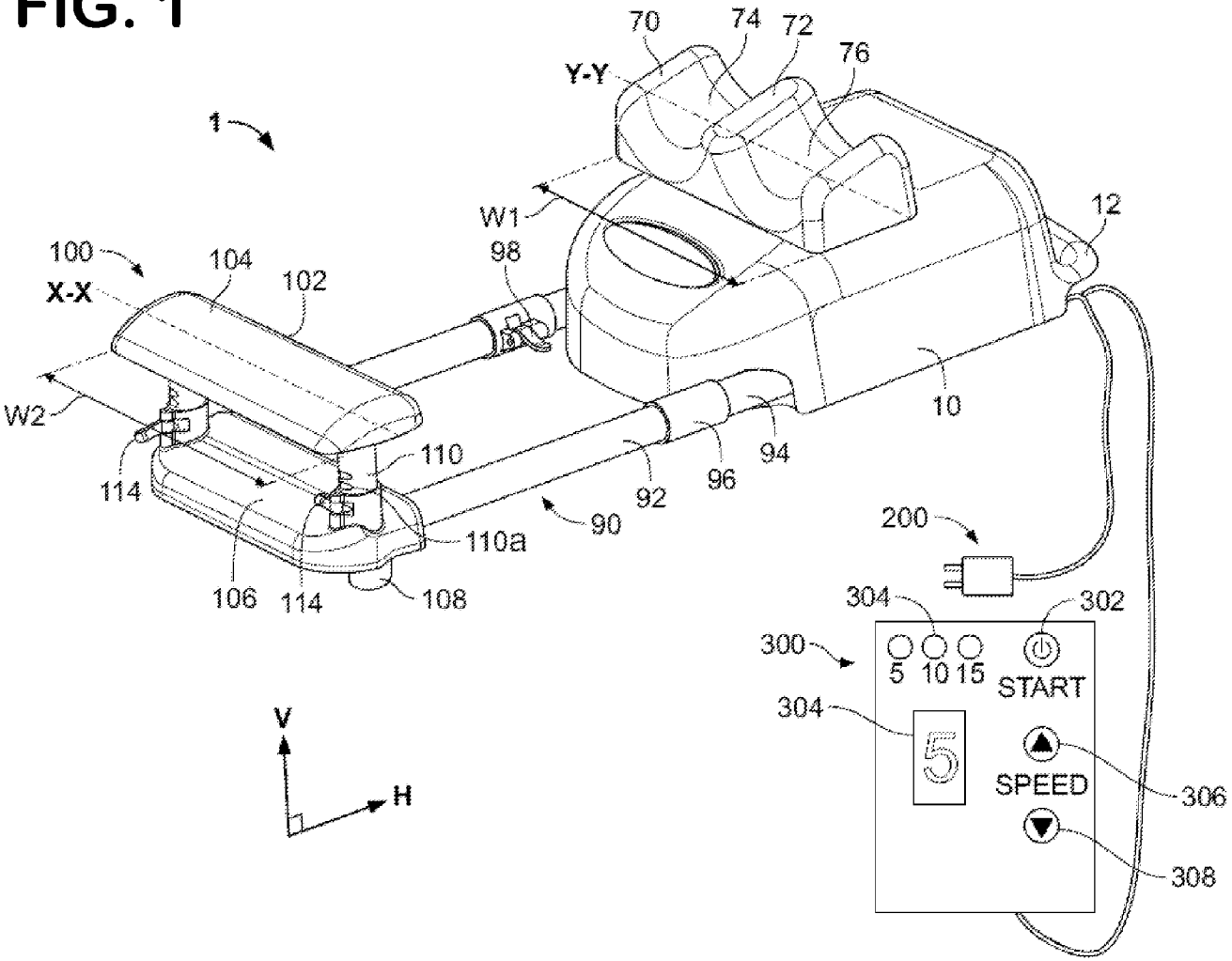
FIG. 1 is a front perspective view of an exercise device in accordance with the concepts presented herein.
Figure 2:
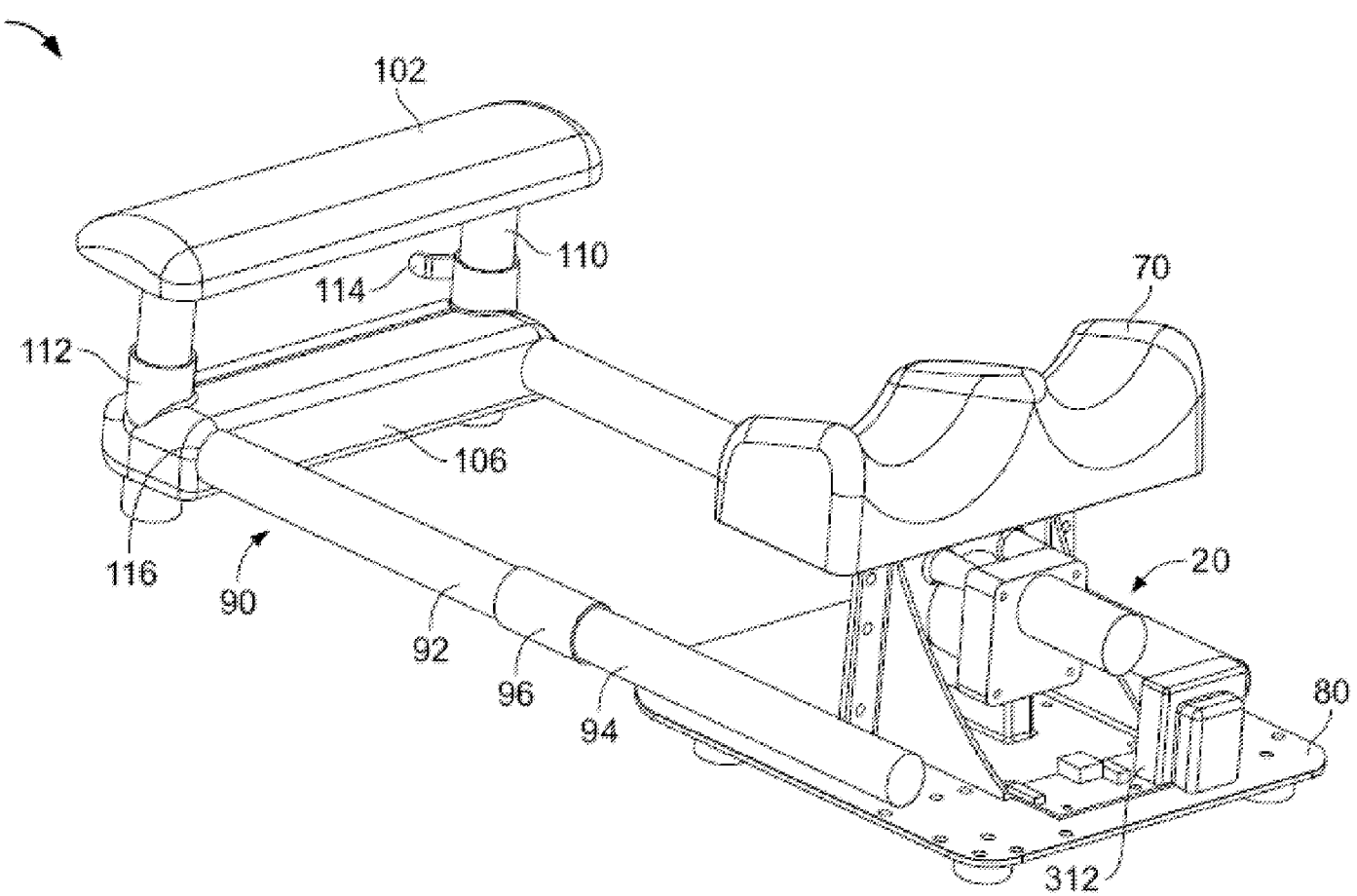
FIG. 2 shows a perspective view of the exercise device shown in FIG. 1 with a housing removed.
Figure 3:
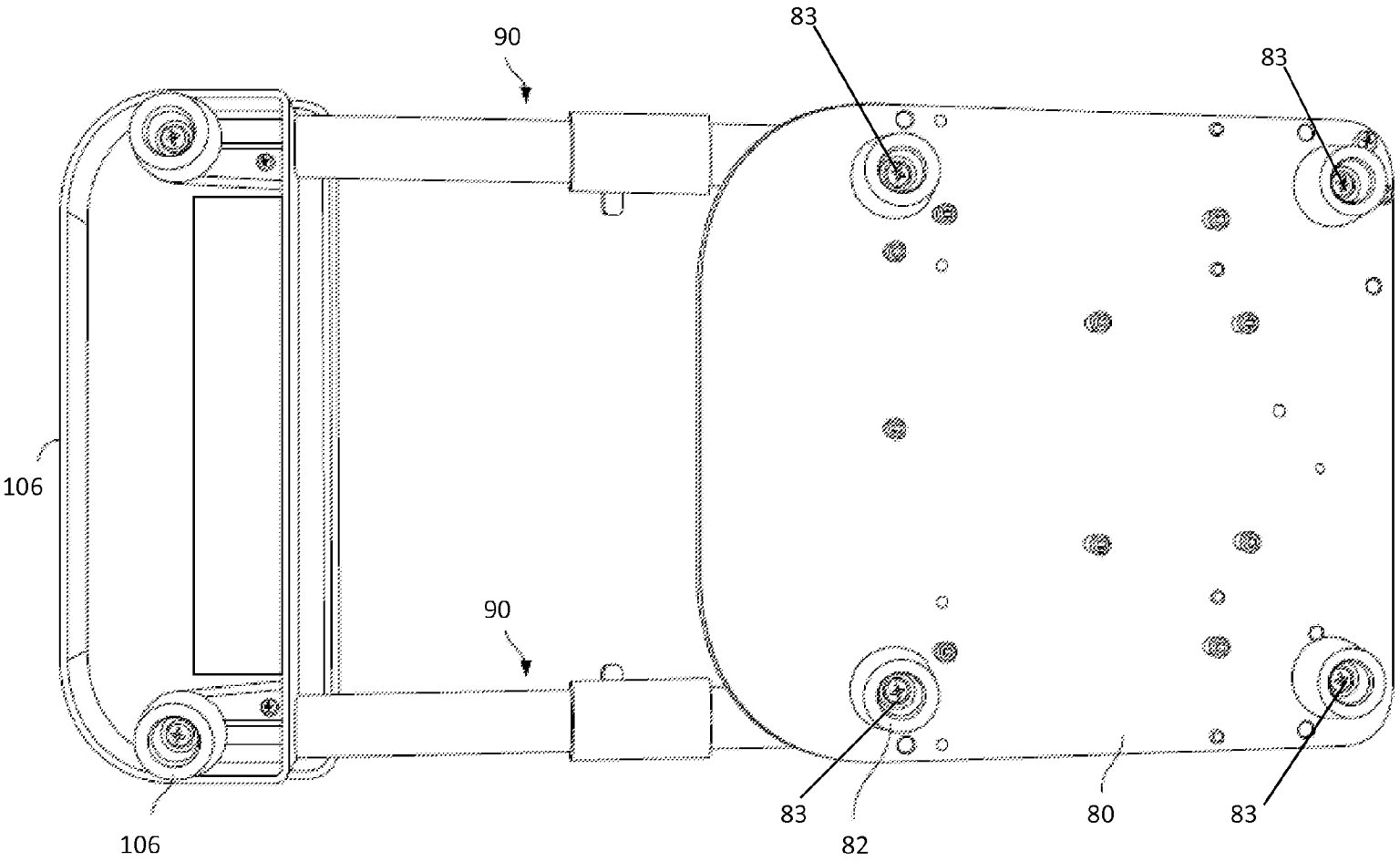
FIG. 3 shows a bottom view of the exercise device shown in FIG. 1.
Figure 4:
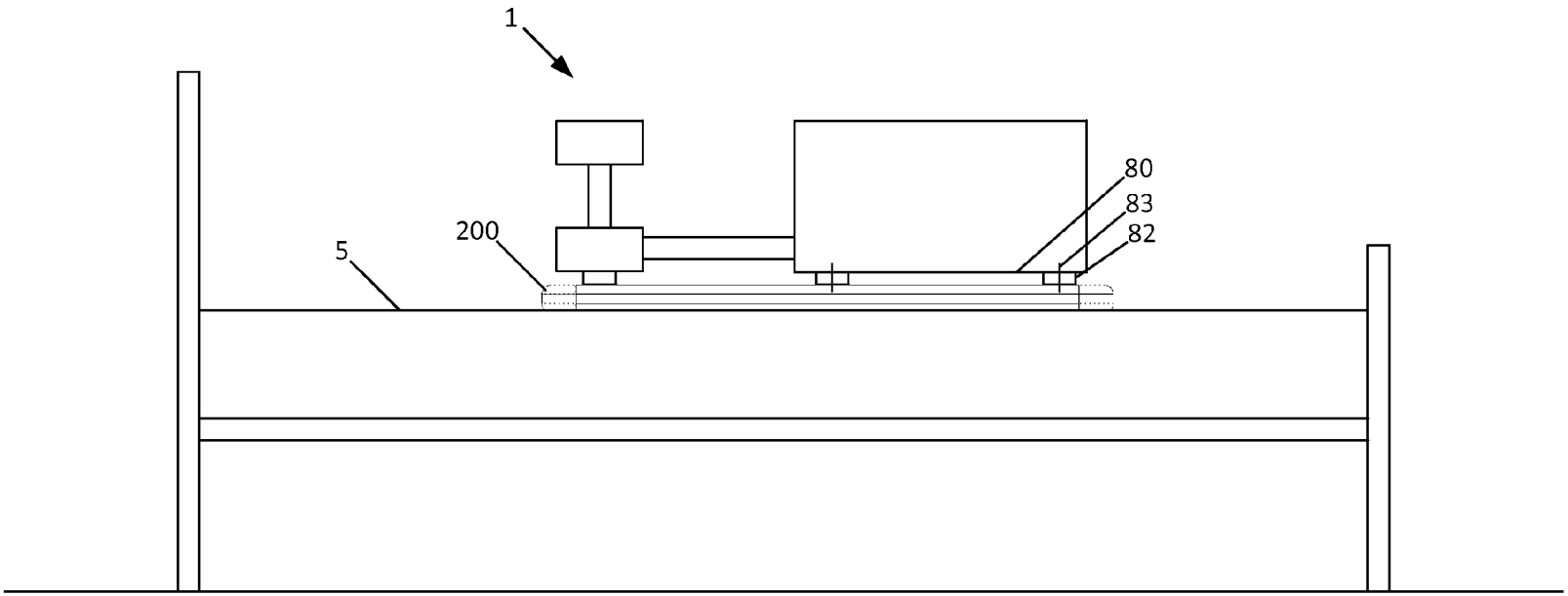
FIG. 4 shows a side view of the exercise device shown in FIG. 1 including and being supported by a bed adapter to form an exercise device assembly resting on a bed.
Figure 5:
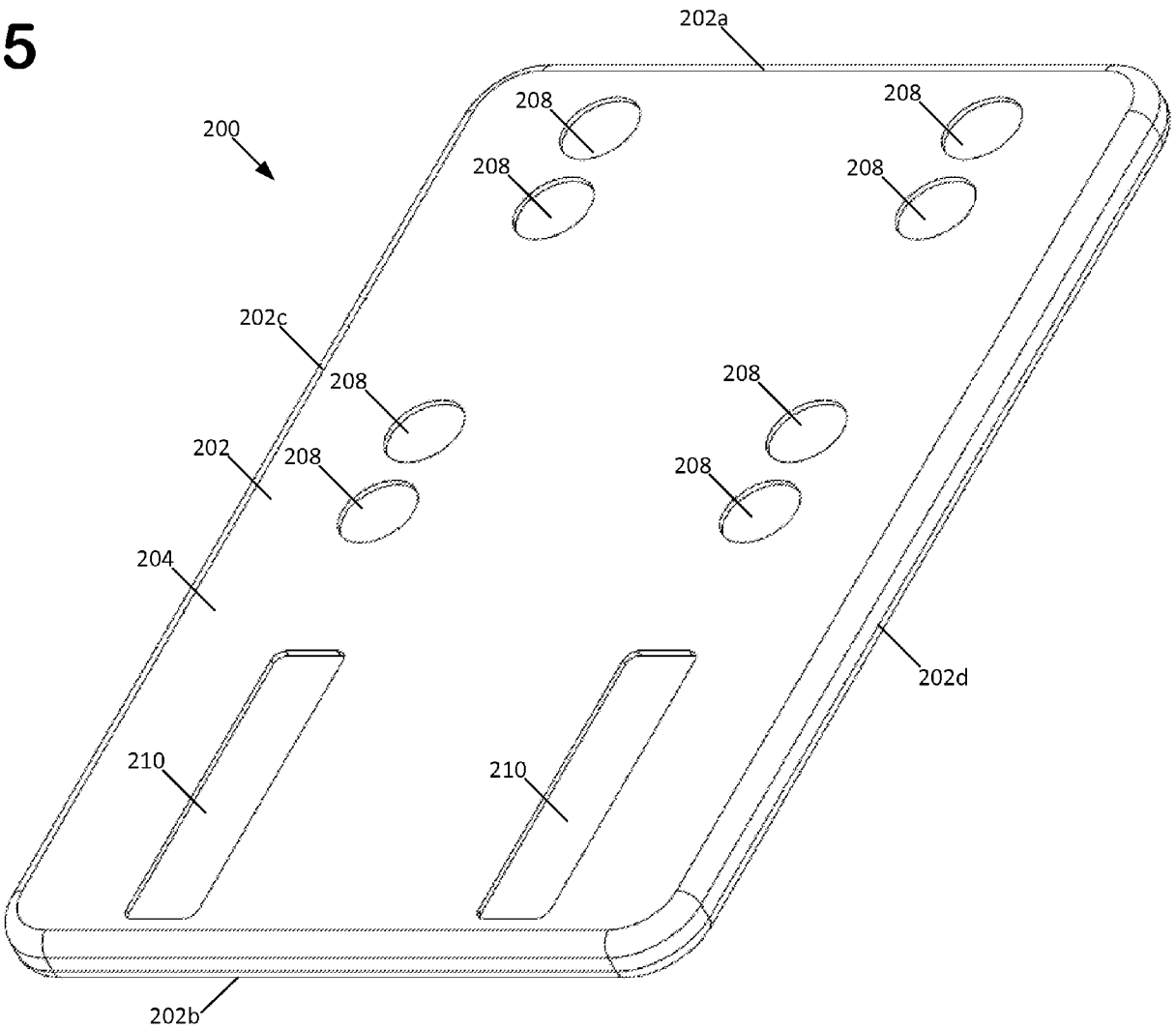
FIG. 5 shows a perspective view of the bed adapter shown in FIG. 4.
Figure 6:
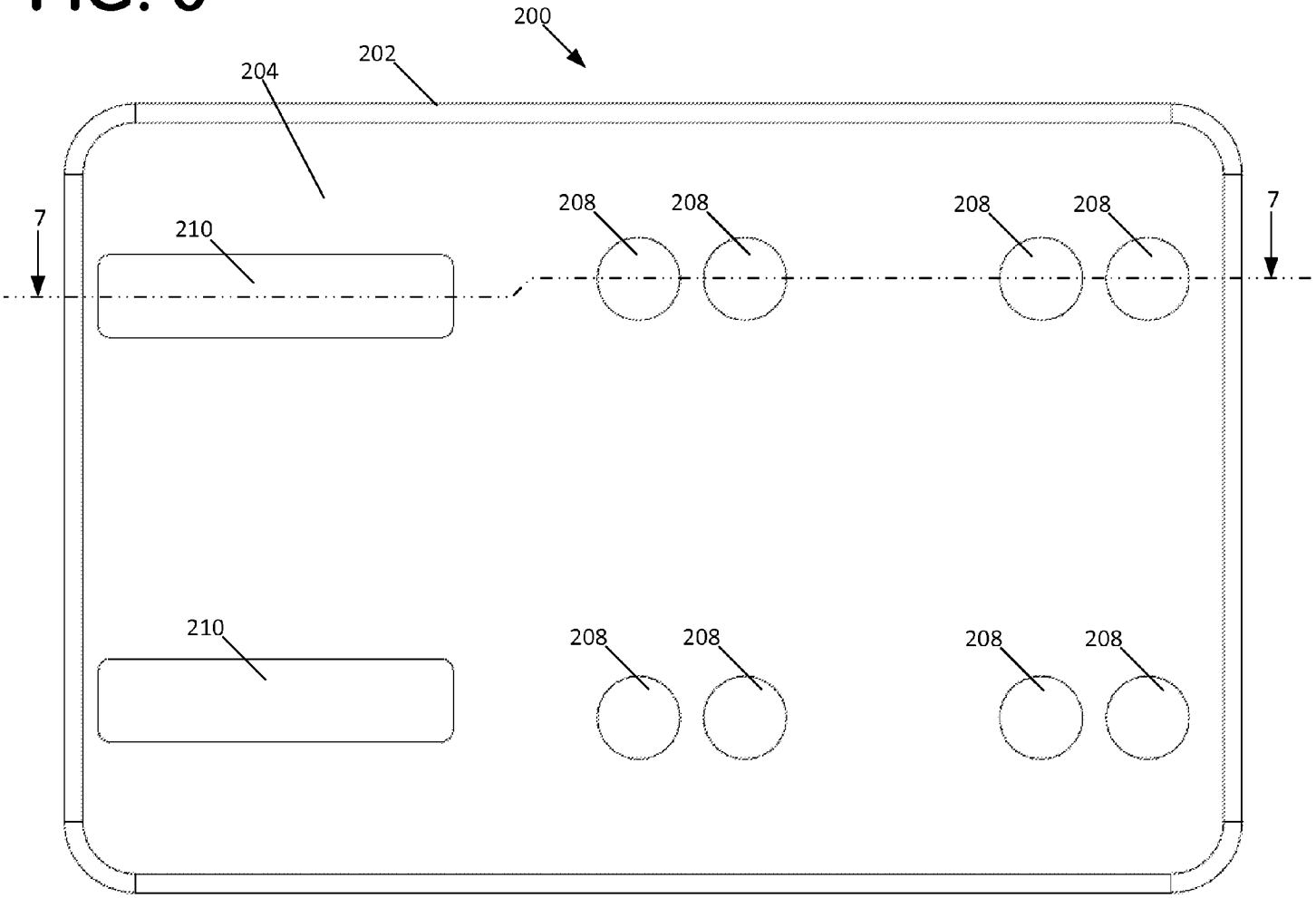
FIG. 6 shows a top view of the bed adapter shown in FIG. 4.

Referring to FIGS. 1-3, an exercise device 1 is shown. An exercise device of the same construction is more fully shown and described in U.S. Pat. No. 8,435,192 entitled Exercise Device with Knee Rest, the entirety of which is incorporated by reference herein. In one embodiment, exercise device 1 has a housing 10 and a handle 12. Housing 10 is for providing an aesthetic appearance to the exercise device 1 and also for protecting a drive mechanism, for example motor 20 and controller 312. Handle 12 is for transporting the exercise device 1 and is shown as being integrally molded into the housing 10. In the particular embodiment shown, housing 10 and handle 12 are constructed from ABS plastic. However, other materials may be used.

Still referring to FIG. 1, exercise device 1 is further shown as having an ankle rest 70. Ankle rest 70 is for imparting a side-to-side motion onto a user's legs via the ankles of the user. This motion may reduce the unnatural twist and flex forces of the joints between the ankles and hips of the body. To facilitate this, ankle rest 70 is provided with a top surface 72 having a pair of recesses 74, 76 within which a user may place his or her ankles The ankle rest 70 also has a width W1 that is sufficient to ensure that the recesses are able to be sufficiently spaced apart. In the embodiment shown, W1 is about 12 inches. In operation, the ankle rest 70 reciprocates in a direction in line with a longitudinal axis Y-Y of the ankle rest through action of the motor 20 within the housing 10. The longitudinal axis Y-Y is generally perpendicular to a length of the user's legs. In the particular embodiment shown, ankle rest 70 has a molded foam construction to minimize point pressure on the user. However, other materials may be utilized.

Still referring to FIGS. 1 and 2, a knee rest 100 is shown. Knee rest 100 is for supporting the back of a user's knees while using the exercise machine 1. The knee rest can also aid in centering the arc through which a user's legs swing, preferably centering the arc in the pelvis region. As shown, knee rest 100 has an upper member 102 defining a top surface 104. In one embodiment, top surface 102 is rounded to have a contoured shape to make the knee support more comfortable for a user. As can be seen at FIG. 1, the upper member 102 of the knee rest 100 has a width W2 and a longitudinal axis X-X. In the embodiment shown, width W2 is about 14 inches which is slightly greater than the width W1 of the ankle rest 70. Longitudinal axis X-X is generally parallel to the longitudinal axis Y-Y of the ankle rest 70.

In the exemplary embodiment shown, the upper member 102 is connected to a base member 106 by a pair of support legs 110. Base member 106 is for supporting upper member and for providing a connection point between the knee rest 100 and the frame 80 of the housing 10. As shown, base member 106 has a pair of rubber support feet 108 for contacting the surface on which exercise device 1 rests. Support feet 108 also provide for vibration isolation. Base member 106 further includes a pair of collars 112 for receiving support legs 110. Support legs 110 are slidable within the collars 112 such that the upper member 102 of the knee rest 100 can be adjusted in a vertical direction V. By use of the term "vertical direction" is meant a direction that is generally perpendicular to the surface on which the exercise device 1 rests which is also the plane of the base plate 80. This adjustment allows an individual user to set the knee rest 100 height at a satisfactory level. In one position, the height of the upper member 102 is set to be lower than the height of the ankle rest 70 (i.e. axis X-X is lower in the horizontal plane than axis Y-Y). In the embodiment shown, upper member 102, base member 106, and support legs 110 are constructed from ABS plastic, although other materials and shapes may be used.

As shown, each collar 112 includes a locking mechanism 114 that operates to bind each leg 108 to the collar 112. This feature ensures that once the vertical height of the knee rest 100 is set, that it is securely retained in this position. In one embodiment, the legs 110 have a plurality of notches 110*a* for receiving a detent 114*a* on the locking mechanism 112. In one embodiment the locking mechanism 114 is a latch. However, those skilled in the art will appreciate that other means for locking the legs 110 may be used, such as pins. Referring to FIG. 12, the locking mechanism 114 is in an unlocked position. Referring to FIG. 13, the locking mechanism 114 is in a locked position. In the embodiment shown, collars 112 and locking mechanism 114 are primarily constructed from ABS plastic, although other materials may be used.

In the exemplary embodiment shown, the base member 106 of the knee rest 100 is connected to the base plate 80 of the housing 10 by a pair of extension legs 90. Extension legs are for horizontally spacing the knee rest 100 from the ankle rest 70 a desired distance such that the exercise device 1 can be adjusted to accommodate the particular leg length and proportions of a particular user.

As shown, each extension leg 90 includes an inner member 92 that is slidable within an outer member 94. The inner member 92 is received into recess 116 and secured by screws (not shown) while the outer member is shown as being secured to the base plate 80 via clamps 99. One skilled in the art will appreciate that inner and outer members 92, 94 may be respectively attached to the base member 106 and base plate 80 by a variety of means known in the art. In the embodiment shown, members 92, 94 are aluminum tubes. However, one skilled in the art will appreciate that other materials and shapes may be used.

Figure 10:
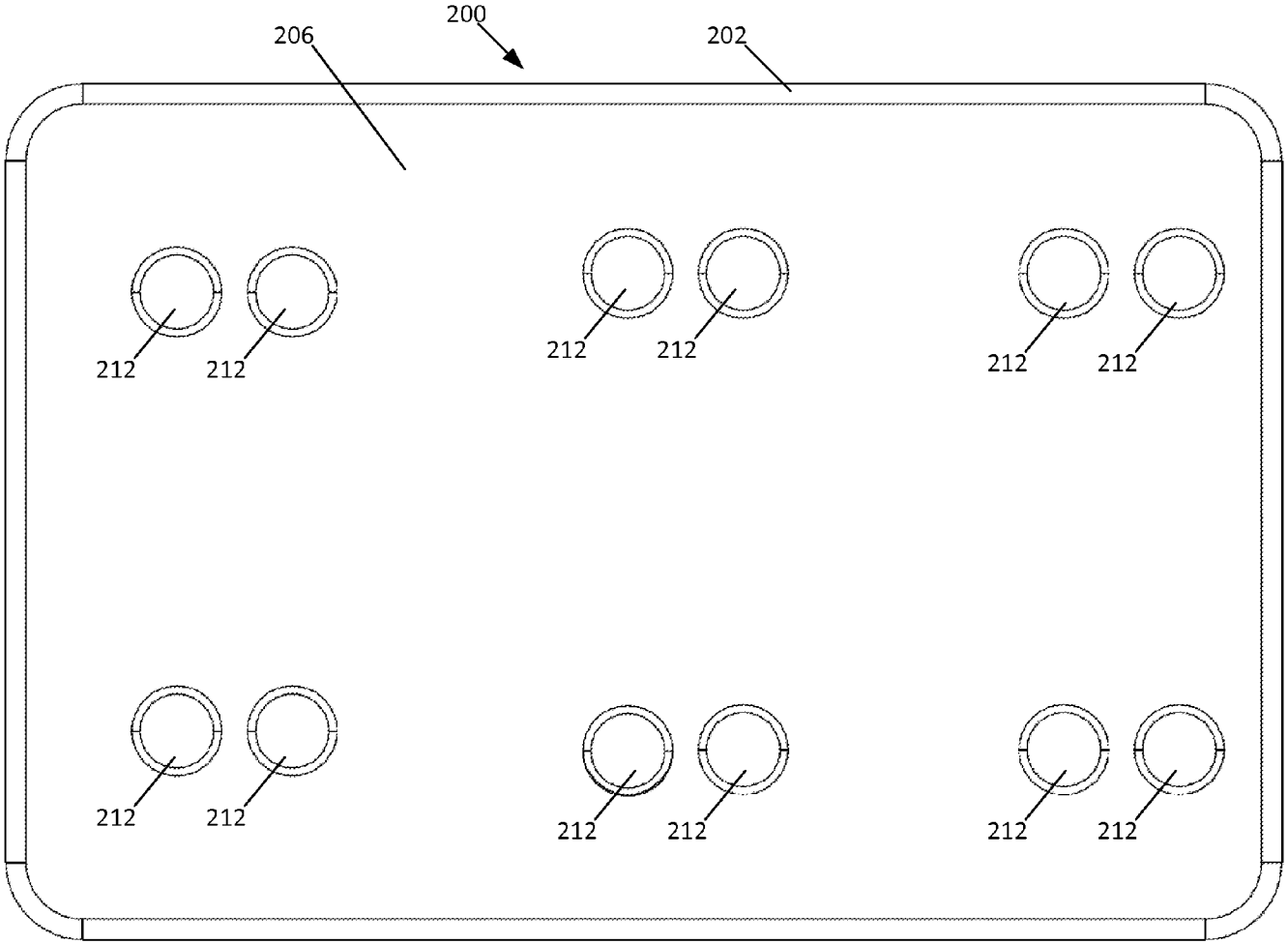
FIG. 10 shows a bottom view of the bed adapter shown in FIG. 4.

Each extension leg 90 is also provided with a collar 96 having a locking mechanism 98. In the embodiment shown, collar 96 and locking mechanism 98 are secured to outer member 94 and configured such that locking mechanism can selectively engage the inner member 92. In one embodiment, locking mechanism 98 is a latch. However, those skilled in the art will appreciate that other means for locking the legs 110 may be used, such as pins. In the embodiment shown, collar 96 and locking mechanism 98 are primarily constructed from ABS plastic, although other materials may be used. Referring to FIG. 10, the locking mechanism 98 is shown in an unlocked position. FIG. 11 shows the locking mechanism 98 in a locked position.

By operation of the locking mechanism 98, the relative position of the inner member 92 to the outer member 94 may be set to a fixed position. Because the inner member 92 is slidable with respect to the outer member 94, the knee rest 100 position may be adjusted in a horizontal direction H such that the desired spacing between the knee rest 100 and the ankle rest is achieved (i.e. axis X-X is spaced a desired horizontal distance from axis Y-Y). By use of the term "horizontal direction" is meant a direction that is generally parallel to the surface on which the exercise device 1 rests and perpendicular to the longitudinal axis X-X of the leg rest 100.

Referring to FIGS. 1 and 3, it can be seen that the device 108 may be provided with a plurality of support members for supporting the device. For example, the knee rest can be provided with support members 108 and the base plate 80 can be provided with support members 82. As shown, two support members 108 are provided and four support members 82 are provided. However, more or fewer support members may be provided as needed or desired. In one embodiment, the support members 108, 82 are rubber members that are mechanically fastened to the knee rest 100 and base plate 80, respectively. In the embodiment shown, the support members 82, 108 are mechanically fastened by nuts and bolts. However, other well-known connection means may be utilized, such as screws and adhesives. Also, the support members 108, 82 could be integrally molded or provided as a portion of the knee rest 100 and base plate 80, respectively.

Referring back to FIG. 1, an electrical connection 200 and a controller 300 are shown. Electrical connection 200 is for supplying power to the motor 22 of the exercise device 1 while controller 300 is for controlling the speed and operating period of the motor 22. In one embodiment, controller 300 includes a power button 302 for activating and deactivating the motor 22 and for setting the running time for the motor 22. A plurality of indicator lights 304 are provided on the controller 300 to show the selected running time period. In operation, a user can depress the power button 302 one, two, or three times to select a first, second, or third time period, for example, five, ten, or fifteen minutes. At the expiration of the time period, or upon depressing the power button 302 a fourth time, the motor 22 is deactivated. The controller 300 also includes a button 306 for increasing motor speed and a button 308 for decreasing motor speed via a speed controller 312. An indicator 304 may be provided to show the motor speed that is selected. In one embodiment, the motor 22 can be set to six different speeds. One skilled in the art will appreciate that other modes of operation are possible.

Bed Adapter

Referring to FIGS. 4-10, a bed adapter 200 is shown for allowing the exercise device 1 to be used on a bed 5, or at any location having a soft and/or uneven surface. In combination, the exercise device 1 an the bed adapter 200 form an exercise device assembly. The bed adapter 200 functions to stabilize the exercise device 1 by providing a generally flat bottom surface 202 that has a surface area that is significantly greater than the combined surface area of the support members provided on the exercise device, for example support members 82 and 108. Consequently, the bed adapter 200 makes the exercise device 1 significantly less susceptible to canting and pitching when placed on a soft surface, as compared to an exercise device 1 having individual feet or support members that can place considerable point pressure on the soft surface and allow the exercise device 1 to drop at those locations.

The bed adapter 200 may be physically attached to the exercise device 1, may be formed integrally with the base portion (housing 10 and/or base plate 80) of the exercise device 1, or may be provided as a separate component upon which the exercise device 5 rests. Additionally, the bed adapter 200 may be used with an exercise device that is provided with or without the knee rest 100. In one embodiment, the exercise device 1 is attached to the bed adapter 200 via mechanical fasteners, for example fasteners 83 connecting the base plate 80 to the bed adapter 200.

Furthermore, the bed adapter 200 is particularly suited for an exercise device 1 having a knee rest 100 that is adjustable relative to the base portion (i.e. housing 10 and base plate 80), wherein the base portion and the knee portion have a plurality of support members. As can be seen at FIG. 1, there is no structure associated with the exercise device between the knee rest 100 and the base portion 10, 80 that is in the same plane of the support members 82, 108 and capable of engaging with the bed surface to stabilize the exercise device 1. As the bed adapter 200 extends between the knee rest 100 and the base portion 10, 80, the bed adapter thus provides for an even greater support surface than the entire bottom area defined by the knee rest 100 and the base portion 10, 80.

With reference to FIGS. 5-10, it can be seen that the bed adapter 200 is provided with a main body 202 extending between a first side edge 202*a* and a second side edge 202*b* and extending between a third side edge 202*c* and a fourth side edge 202*d*. As shown, the main body 202 is of unitary construction. However, it should be appreciated in light of the disclosure herein that the main body 202 can be formed by multiple attached components. In one aspect, the main body 202 defines a first support side 204 and a second support side 206 opposite the first side 204.

As shown, the main body 202 can be provided with rounded side edges 202*a*-202*d* extending between the first and second support sides 204, 206 such that no sharp (i.e. 90 degree) corners are present on the main body 202. In one aspect, the first support side 204 is configured for directly supporting the exercise device 1 while the second support side 206 is configured to rest against and to be supported by the bed 5.

On the first support surface 205, a first plurality of receptacles 208 for receiving and retaining the support members 82 associated with the main housing 10, 80 is provided. As shown, eight receptacles 208 are provided in the first support side 204 and are arranged to receive the four support members 82 of the base portion 10, 80 in two different positions. Each of the receptacles 208 is provided with a sidewall 208*a* connecting the main body first support side 204 to a support surface 208*b* of the receptacle 208.

Figure 7:
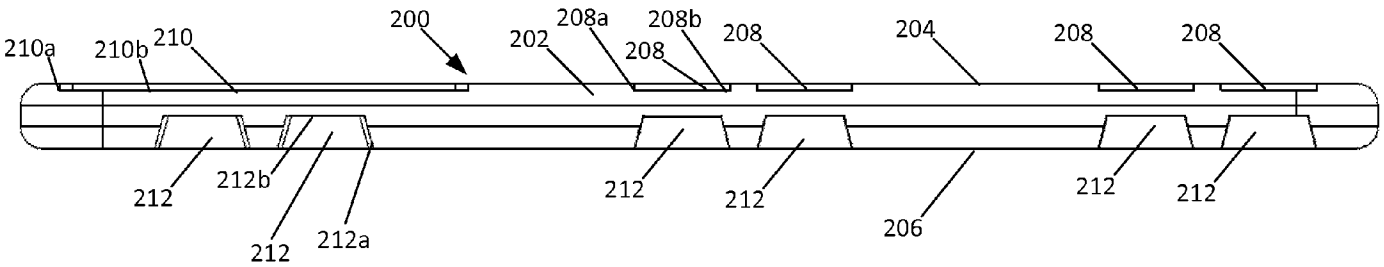
FIG. 7 shows a cross-sectional side view of the bed adapter shown in FIG. 4, taken along the line 7-7.
Figure 8:
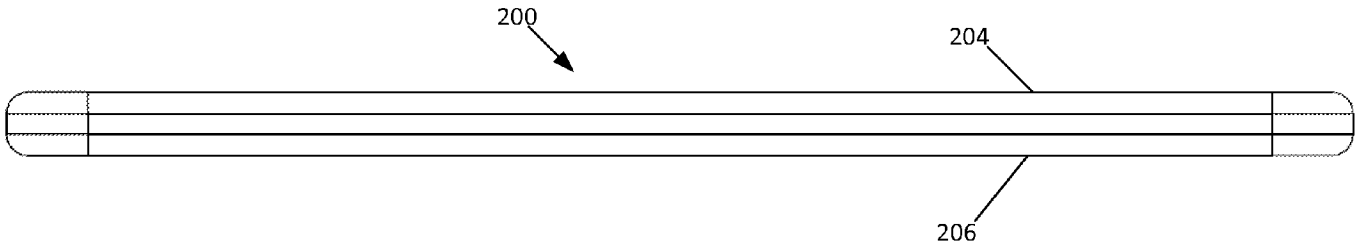
FIG. 8 shows a side view of the bed adapter shown in FIG. 4.
Figure 9:
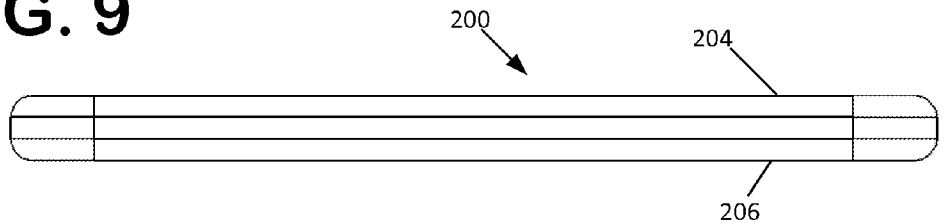
FIG. 9 shows an end view of the bed adapter shown in FIG. 4.

As most easily seen at FIG. 7, the support surfaces 208*b* of the receptacles 208 are aligned along a common plane that is recessed from the plane defined by the surface of the first support side 204. In one aspect, the receptacles 208 are configured to have a larger dimension (i.e. diameter) than that of the support members 82 such that support members 82 extend into the receptacles 208. Accordingly, the support members 82 rest upon and are supported by the support surfaces 208*b* of the receptacles 208 and are restrained from lateral movement by the sidewalls 208*a* of the receptacles 208. As shown, the receptacles 208 are circular in shape. However, other shapes may be provided in light of the teachings presented herein.

On the first support surface 205, a second plurality of receptacles 210 for receiving and retaining the support members 108 associated with the knee rest 100 is provided. As shown, two slot-shaped receptacles 210 are provided in the first support side 204 and are arranged to receive the two support members 108 of the knee rest 100. As shown, each of the receptacles 210 is provided with a sidewall 210*a* connecting the main body first support side 204 to a support surface 210*b* of the receptacle 210.

As most easily seen at FIG. 7, the support surfaces 210*b* of the receptacles 210 are aligned along a common plane that is recessed from the plane defined by the surface of the first support side 204 and that is also in line with the plane defined by the support surface 208*b* of the first plurality of receptacles 208. In one aspect, the receptacles 210 are configured to have a larger dimension (i.e. diameter) than that of the support members 82 such that support members 108 extend into the receptacles 210. Accordingly, the support members 108 rest upon and are supported by the support surfaces 210*b* of the receptacles 210 and are restrained from lateral movement by the sidewalls 210*a* of the receptacles 210. However, and in contrast to the receptacles 208, receptacles 210 are provided as elongated receptacles that allow the support members 108 to move back and forth in a direction between the first and second sides 202*a*, 202*b* (i.e. axis H of the exercise device 1). This configuration advantageously allows for the position of the knee rest 100 to be adjusted while the exercise device 1 is being supported by the bed adapter 200 so that a person does not have to leave the bed and move to the floor or another hard surface in order to ascertain the correct position for the knee rest 100. Other shapes for the receptacles 210 may be provided in light of the teachings presented herein.

As shown, the receptacles 208 and 210 are configured such that their respective support surfaces 208*b* and 210*b* are recessed from the plane defined by the main body 202 by about one eighth of an inch. However, other recess depths between the support surfaces 208*b*, 210*b* and the first support side 204 may be utilized without departing form the concepts presented herein. Additionally, although the sidewalls 208*a*, 210*a* are shown as being generally perpendicular to the plane defined by the first support surface 204, the sidewall may be angled such that the dimension of the receptacles 208*a* and/or 210*a* decreases from the first support surface 204 to the support surfaces 208*b*, 210*b*. Such a configuration would facilitate easier initial positioning of the exercise device 1 with a wider opening near the first support surface 204 and more securely hold the support members 80, 108 with a narrower opening near the support surfaces 208*b*, 210*b*.

In one example, the main body 202 is formed from a polymeric material by a molding process (e.g. injection molding, rotational molding, blow molding, etc.). In one example, the main body 202 is provided with a hollow interior 214. To provide structural support to the receptacles 208, 210 (and the main body), structural recesses 212 may be provided at the second side 206 of the main body 202 opposite the receptacles 208, 210. As configured, the structural recesses 212 have sidewalls 212*a*, connecting the surface 206 to a surface 212*b*, that aid in supporting the support surfaces 208*b*, 210*b* such that the support surfaces are sufficiently strong to support the weight of the exercise device 1 and the weight of a user's legs without undue deflection of the support surfaces 208*b*, 21*b* and the main body 202. Although the structural recesses 212 are shown as being provided with a circular shape, other shapes can be used without departing from the concepts presented herein.

In light of the presently disclosed teachings, the bed adapter 200 allows any person, and especially a bed-ridden person, to make full use of an adjustable exercise device 1 on a soft surface (e.g. a bed, couch, sofa, etc.) upon which the person is supported and to further be able to set the adjustments of the exercise device without having to leave the soft surface. Accordingly, the bed adapter 200 allows some persons to utilize an exercise device 1 who would otherwise be unable to do so.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

I claim:

1. An exercise device assembly comprising:

(a) an exercise device having:

(i) a base plate supporting a reciprocating ankle rest that has a longitudinal axis, the base plate being provided with a first plurality of support members at a bottom side for supporting the base frame;

(ii) a knee rest connected to the base plate, the knee rest having a longitudinal axis that is generally parallel to a longitudinal axis of the ankle rest, the knee rest being adjustable in a horizontal direction relative to the longitudinal axis of the ankle rest, the knee rest being provided with a second plurality of support members at a bottom side for supporting the knee rest;

(b) a bed adapter including:

(i) a main body defining a first side and a second side, the main body being connected to the base plate;

(ii) a first plurality of receptacles receiving and retaining the first plurality of support members, each of the first plurality of receptacles being disposed in the main body first side and having a sidewall connecting the main body first side to a support surface of the receptacle; and (iii) a second plurality of receptacles receiving and retaining the second plurality of support members, each of the second plurality of receptacles being disposed in the main body first side and having a sidewall connecting the main body first side to a support surface of the receptacle.

2. The exercise device assembly of claim 1, wherein the bed adapter is attached to the exercise device with fasteners extending through at least some of the first plurality of receptacles.

3. The exercise device assembly of claim 2, wherein each fastener extends through at least one of the first plurality of receptacles and through at least one of the support members.

4. The exercise device assembly of claim 1, wherein each of the first plurality of receptacles has a generally round shape.

5. The exercise device assembly of claim 1, wherein each of the second plurality of receptacles are generally slot-shaped.

6. The exercise device assembly of claim 1, wherein the first plurality of receptacles includes four generally round receptacles and the second plurality of receptacles includes two generally slot-shaped receptacles.

7. The exercise device assembly of claim 1, wherein the main body is formed from a plastic material.

8. The exercise device assembly of claim 1, wherein the main body has a hollow interior.

9. The exercise device assembly of claim 1, wherein the main body has side edges extending between the first and second sides and wherein edges formed between the side edges and the first and second sides are rounded.

10. The exercise device assembly of claim 1, wherein the support surface of the first plurality of receptacles and the support surface of the second plurality of receptacles are aligned along a common plane.

11. The exercise device assembly of claim 10, wherein the common plane is recessed from the main body first side by about one eighth of an inch.

* * * * *